US006998977B2

(12) United States Patent
Gregori et al.

(10) Patent No.: US 6,998,977 B2
(45) Date of Patent: Feb. 14, 2006

(54) METHOD AND APPARATUS FOR MONITORING A MOVABLE BARRIER OVER A NETWORK

(75) Inventors: Eric M. Gregori, Lake Lindenhurst, IL (US); Eric Peterson, Joliet, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 211 days.

(21) Appl. No.: 10/606,984

(22) Filed: Jun. 26, 2003

(65) Prior Publication Data

US 2005/0012631 A1 Jan. 20, 2005

Related U.S. Application Data

(63) Continuation-in-part of application No. 10/424,404, filed on Apr. 28, 2003.

(51) Int. Cl.
*G08B 26/00* (2006.01)

(52) U.S. Cl. ..... 340/505; 340/5.71; 49/14

(58) Field of Classification Search ..... 340/505, 340/686.1, 545.1, 5.7, 5.71; 49/14

See application file for complete search history.

(56) References Cited

U.S. PATENT DOCUMENTS

| | | | | |
|---|---|---|---|---|
| 4,533,905 | A * | 8/1985 | Leivenzon et al. | 340/524 |
| 4,583,081 | A * | 4/1986 | Schmitz | 340/686.6 |
| 5,596,840 | A * | 1/1997 | Teich | 49/26 |
| 5,969,637 | A * | 10/1999 | Doppelt et al. | 340/825.69 |
| 6,166,634 | A * | 12/2000 | Dean | 340/545.1 |
| 6,388,559 | B1 * | 5/2002 | Cohen | 340/5.71 |
| 6,553,238 | B1 * | 4/2003 | Ginzel et al. | 455/557 |
| 6,597,291 | B1 * | 7/2003 | Tsui | 340/686.1 |
| 2001/0017483 | A1 | 8/2001 | Frohberg | |

FOREIGN PATENT DOCUMENTS

| | | | |
|---|---|---|---|
| JP | 2002019548 | A | 1/2002 |
| JP | 2004088774 | A | 3/2004 |
| KR | 2002032461 | A | 5/2002 |

OTHER PUBLICATIONS

*Picdem.net Internet/Ethernet Demonstration Board DM163004*. Chandler, AZ: Microchip, Feb. 2001.

Search Report for GB 0414221.2 completed on Nov. 9, 2004.

* cited by examiner

*Primary Examiner*—Toan N. Pham
(74) *Attorney, Agent, or Firm*—Fitch, Even, Tabin & Flannery

(57) ABSTRACT

An apparatus comprising a movable barrier operator for controlling the movable barrier; and a network interface electronically connected to the movable barrier operator for connecting the movable barrier to a network; wherein the network board sends a status of the movable barrier over the network to a requesting device.

25 Claims, 4 Drawing Sheets

METHOD AND APPARATUS FOR MONITORING A MOVABLE BARRIER OVER A NETWORK

RELATED APPLICATIONS

This application is a continuation-in-part of U.S. application Ser. No. 10/424,404 filed Apr. 28, 2003.

FIELD OF THE INVENTION

The present invention relates generally to movable barriers. More specifically, but without limitation thereto, the present invention relates a monitoring system for a movable barriers.

BACKGROUND OF THE INVENTION

Movable barriers, e.g., garage doors, have typically been opened and closed manually by a user. More recently, moveable barriers have been connected to movable barrier operators, e.g., garage door operators. This allows the movable barrier to be opened and closed through the activation of the movable barrier operator. In many instances, generally due to human error, a movable barrier may be left open when the user had intended that it be closed. In order to check the status of the movable barrier the user would go look at the movable barrier to see if it was open or closed. Typically, however, a person will not remember to check whether the movable barrier has been left open or will remember at an inconvenient time. Systems which monitor the status of the movable barrier are available. Such systems notify a user that the movable barrier is open through a visual or audio indicator located remotely from the movable barrier. These systems however, require the user to be in the same proximity as the indicator otherwise the user will never be notified of the status of the movable barrier.

Thus there is a need for a monitoring system for a movable barrier which can solve the problems above.

SUMMARY OF THE INVENTION

The methods and arrangements described and claimed herein advantageously address the needs above as well as other needs by providing method and apparatus which provide the status of the movable barrier over a network.

One embodiment described includes an apparatus, comprising a movable barrier operator for controlling the movable barrier; and a network interface electronically connected to the movable barrier operator for coupling the movable barrier to a network; wherein the network interface sends a status of the movable barrier over the network to a requesting device.

Another embodiment includes a method for sending the status of a movable barrier comprising the steps of receiving over a network from a client computer, a status request for a movable barrier; determining a status of the movable barrier; and sending the status of the movable barrier over the network to the client computer in response to the status request.

A further embodiment includes an apparatus comprising: a status monitor coupled to a movable barrier; and a network interface electronically connected to the status monitor and to a network; wherein the network interface sends a status of the movable barrier over the network in response to a request for the status of the movable barrier.

BRIEF DESCRIPTION OF THE DRAWINGS

The present invention is illustrated by way of example and is not limited in the accompanying figures, in which like references indicate similar elements, and in which.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE PREFERRED EMBODIMENTS

Figure 1:
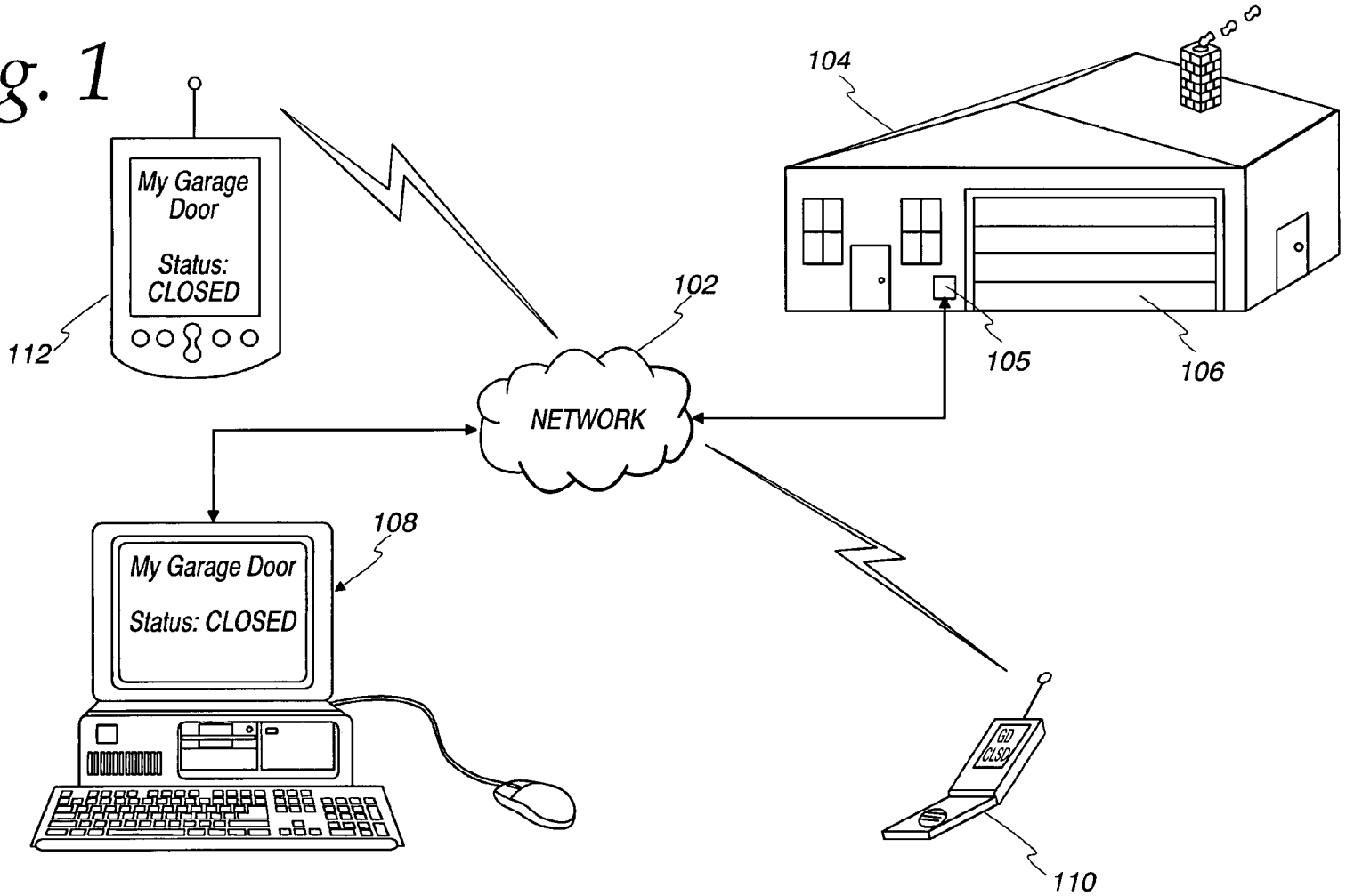
FIG. 1 is a block diagram of a system for monitoring a movable barrier.

FIG. 1 is a functional diagram representing a movable barrier 106 and a barrier status monitor or sensor 105 which is connected to a digital network 102 which may, for example, be the well known Internet. Access to the barrier status may be obtained from any device which can communicate over network 102 such as personal computer 108 and properly equipped PDAs 112 and cellular telephone 110. As discussed in more detail below, the network 102 may also be used to send control commands to a movable barrier operator to cause the barrier to be moved on command.

The movable barrier 106 shown in FIG. 1 is a garage door, however, the movable barrier 106 could be any movable barrier 106, e.g., but not limited to, a gate, a door, a garage door, and a window.

Figure 2:
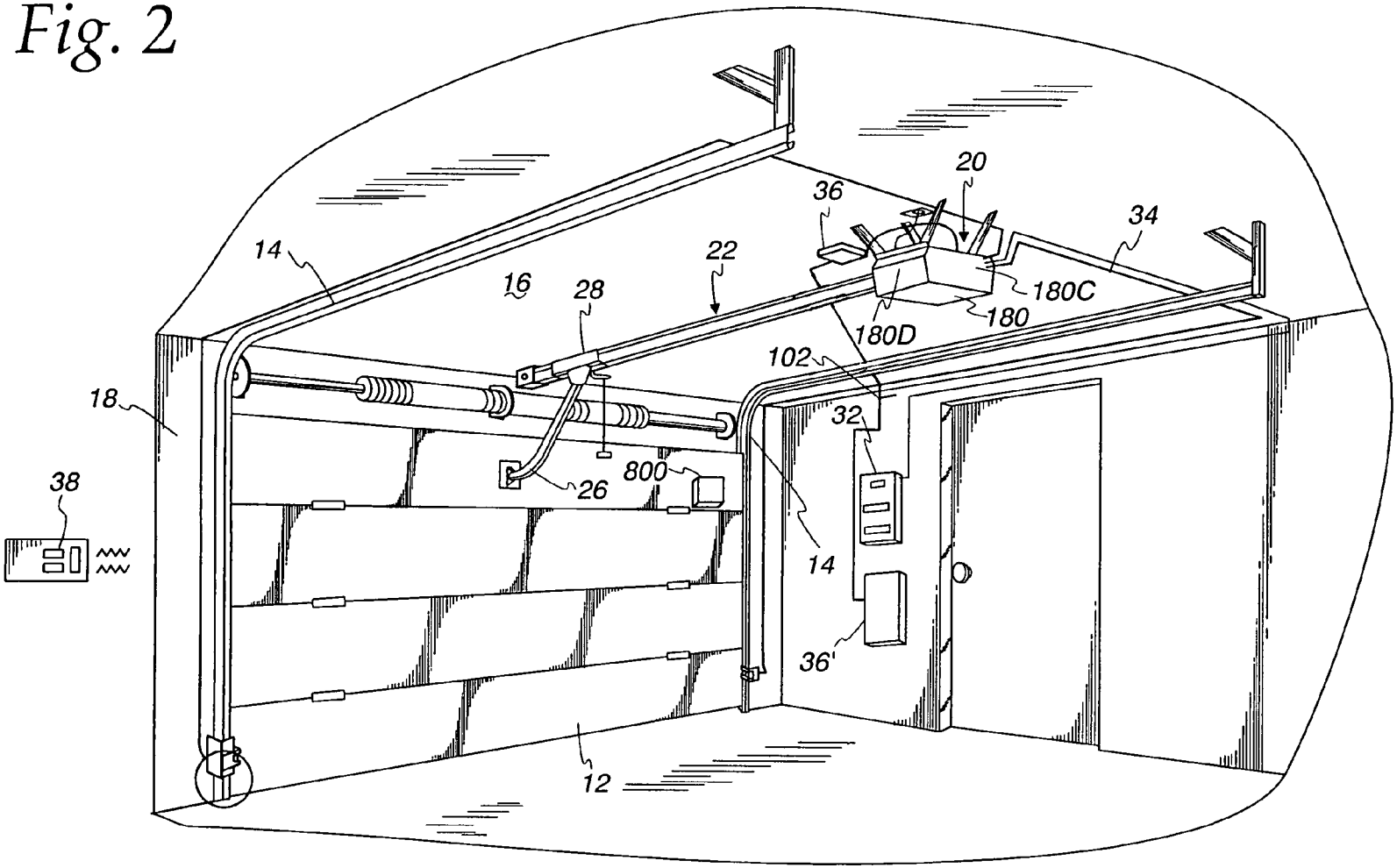
FIG. 2 illustrates a movable barrier operator connected to a network.

FIG. 2 illustrates a movable barrier operator for automatically opening and closing a barrier, which operator is connected to a network 102. Shown is a garage door 12, guide rails 14, a ceiling 16, a wall 18, a power drive unit 20, an integrated drive rail 22, an operator arm 26, a trolley 28, a push button control unit 32, electrical conductors 34, a network interface 36, a remote control transmitter 38, and an auxiliary power drive 40.

The movable barrier operator is employed for controlling the opening and closing of a conventional overhead garage door 12. It should be well understood that the movable barrier operator shown in FIG. 2 is only one embodiment and any properly equipped system for controlling a movable barrier can make use of the status identifying apparatus disclosed herein. The garage door 12 is mounted on the guide rails 14 for movement between the closed position illustrated in FIG. 2 and an open or raised position. Additionally shown are the ceiling 16 and the wall 18 defining an opening blocked by the garage door 12. As shown, the guide rails 14 are mounted to the wall 16 and ceiling 18 in a conventional manner.

The power drive unit 20 is mounted to the ceiling 16 in a conventional manner. The integrated drive rail 22 extends between the power drive unit and the garage wall 18. As can be seen in FIG. 2, an end of the integrated drive rail 22 is mounted to a portion of the garage wall 18 located above the garage door 12. The operator arm 26 is connected at one end to the garage door 12 and at the other end to the trolley 28. The trolley 28 is mounted for movement back and forth, along the drive rail 22. The motor in the power drive unit 20 propels the trolley 28 in a desired manner to raise and lower the garage door 12 via the coupling of the trolley 28 and the operator arm 26 to the garage door 12.

A push button control unit 32, which may include an electronic controller and a keypad, is coupled by electrical conductors 34 to the power drive unit 20 and sends command signals to the power drive unit 20, controlling operation of the drive motor therein. The power drive unit 20 includes a controller 300 (FIG. 3) which controls the motor of power drive 20 to control the movement and/or position of the barrier. Controller 300 responds to input signals such as from optical obstruction sensors, barrier position sensors, and control commands from users to identify the status of the barrier and to energize or de-energize the motor to achieve a user commanded result. The power drive unit 20 may also include a conventional radio receiver, not shown, for receiving authorizing and responding to radio command signals from the remote control transmitter 38.

Figure 3:
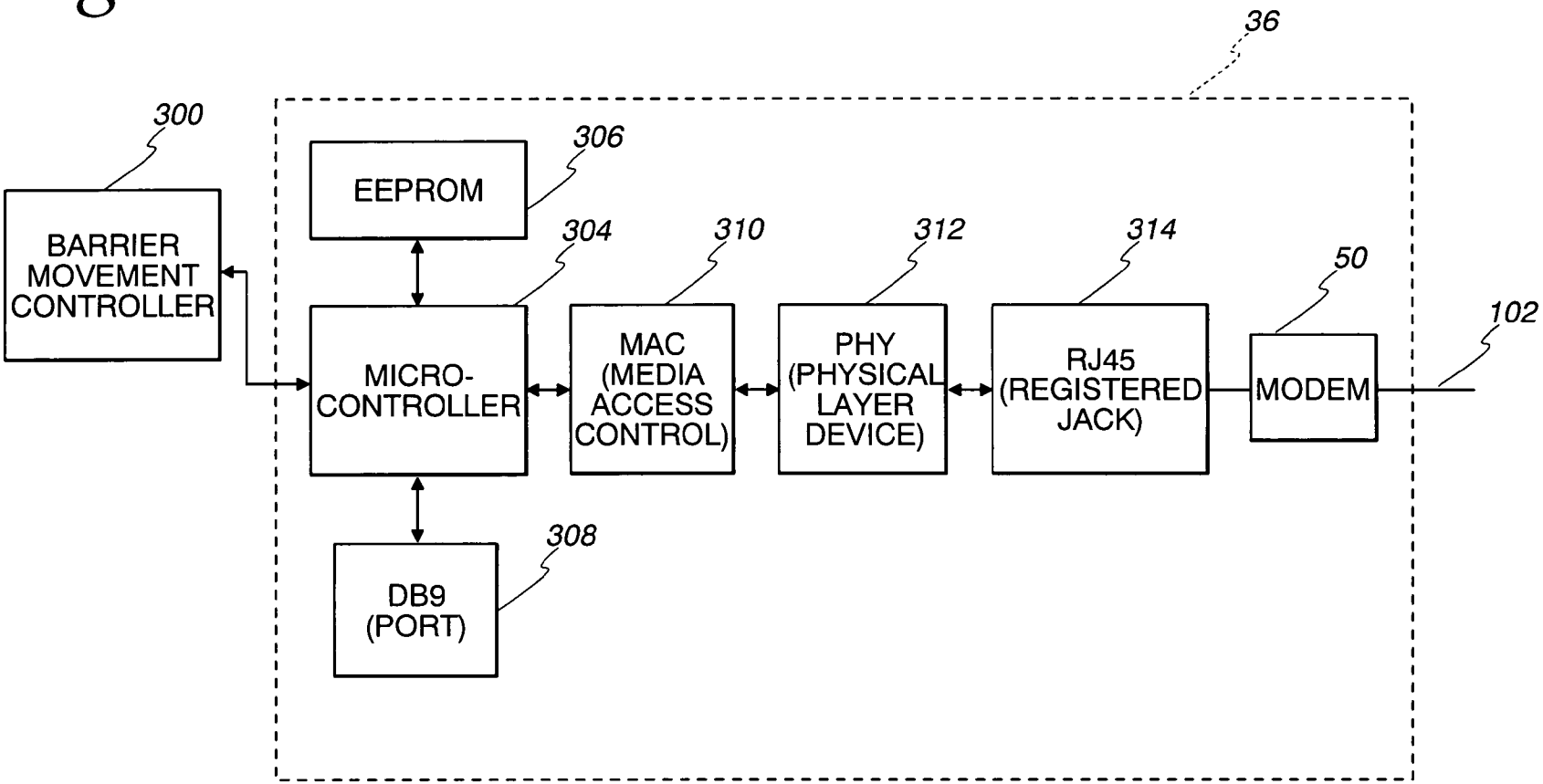
FIG. 3 is a block diagram of a garage door operator connected to a network.

A network interface 36, is coupled to the controller 300 which provides the network interface 36 with information regarding the status of the garage door operator (FIG. 3). The network interface 36 receives signals from the garage door operator which allow the network interface 36 to determine if the garage door 12 is open, closed, stopped in the middle of travel, opening or closing. The network interface 36 is connected to a network 102, e.g., the internet, which allows an individual to connect to the network interface 36 over the network 102 and receive the status of the garage door 12. In one embodiment the network interface 36 comprises a DM163004 Internet/Ethernet Demonstration Board, available from Microchip Technology Inc., 2355 W. Chandler Blvd., Chandler, Ariz. 85224-6199 (www.microchip.com). Detailed information about the network interface 36 is available from Microchip Technology Inc.

FIG. 3 illustrates a block diagram of a garage door operator connected to a network. Shown is a barrier movement controller 300, a micro-controller 304, an eeprom 306, a port 308, a Media Access Control (MAC) Layer 310, a Physical Layer Device (PHY) 312, a jack 314 and a modem 50. FIG. 3 illustrates one embodiment of the present invention, however, most any system for connecting the movable barrier operator to a network 102 can be used. The barrier movement controller 300 is electronically connected to the micro-controller 304. In the present embodiment, the connection is made through an RS232 serial port, however, many any connection means could be used.

The network interface 36, shown in the dashed box of FIG. 3 includes the micro-controller 304, the eeprom 306, the port 308, the media access control layer 310, the physical layer device 312 and the jack 314. The micro-controller 304 runs a minimum TCP/IP stack and presents data out ethernet via HTML. This allows the micro-controller 304 to output HTML web pages. Thus, when a user connects to the network interface 36 over the network 102, the status of the garage door can be viewed through a standard browser, e.g., Internet Explorer™ or Netscape Navigator™. A user connecting to the network interface 36 over a web-enabled cellular telephone 110 or PDA 112 will also be able to view the status of the garage door through the browser available on the cellular telephone 110 or the PDA 112.

The eeprom 306 is electrically connected to the micro-controller 304. In one embodiment the eeprom 306 is a 24L256 serial eeprom. The eeprom 306 can store different web-pages, thus the micro-controller 304 can display different web-pages, e.g., a garage door open web-page and a garage door closed web-page.

The media access control layer 310 controls how a computer on the network gains access to the data and controls whether there is permission to transmit it. Thus, the media access control layer 310 controls who has access to the garage door status. This enables only certain users to access the garage door status over the network 102. For example, the user who is checking the status of the garage door 12 may have to enter a password to be allowed access to the status information.

The physical layer device 312 sends and receives the bit stream representing the data to be conveyed through the network at the electrical and mechanical level. It provides the hardware means of sending and receiving data, including defining cables, cards and physical aspects. The physical layer device 312 is electronically connected to the jack 314, e.g., a RJ45 jack. This allows for the network interface 36 to receive a direct ethernet connection.

The port 308 is coupled to the micro-controller 304 through a RS232 serial port interface. The port 308 is used for the initial setup of the IP and ethernet addresses. The initial setup is performed using a standard terminal program.

In operation a user can log onto the network 102 from a terminal such as computer 108 and through his or her web browser gain access to the web page provided by network interface 36. After the optional password authorization the user can obtain the status of barrier 106 (12) via interface 36. The network 102 also permits two-way communication so that commands can be sent to the interface 36 from an authorized user over the network 102. For example, a user can log onto the network interface 36 and determine that the door is open at a time when it should be closed. The authorized user can then transmit a close command to the network interface via the network 102. Micro-controller 304 will respond to the close command from network 102 by directing barrier movement controller 300 to close the garage door. Similarly, a user can direct the opening of the barrier when such may be needed, for example, to permit entry of service personnel to the garage.

Figure 4:
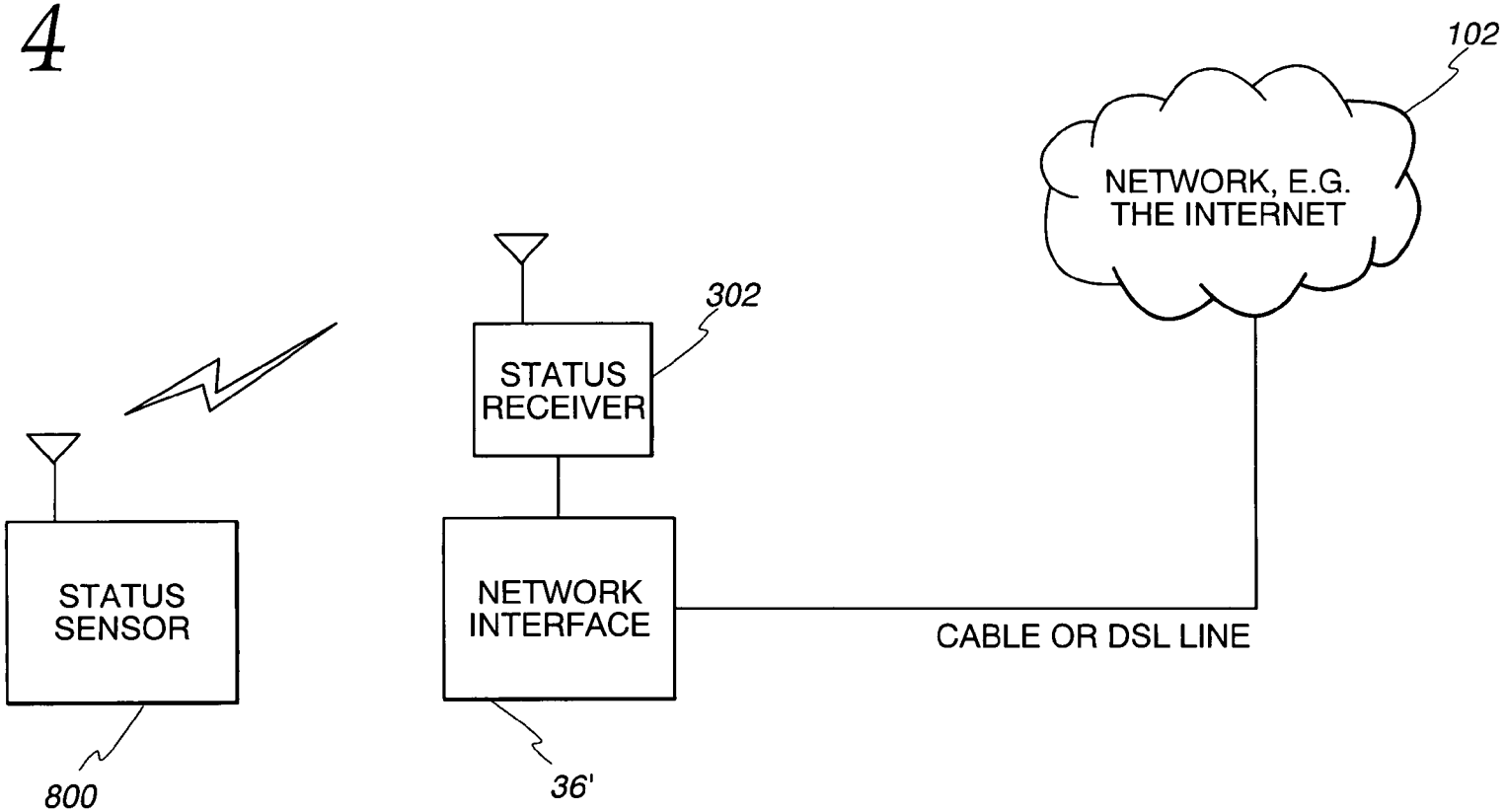
FIG. 4 is a block diagram of a network connected status reporting system including an RF communicating status sensor.

FIG. 2 illustrates a status monitor 800 attached to the movable barrier 12. The status monitor 800 is attached to the movable barrier 12, such that when the movable barrier changes position, e.g., opening or closing, the status monitor 800 detects the change in position. Advantageously, the status monitor can include an RF transmitter, such as is known in the art, for transmitting a status signal to a network interface 36' (FIG. 4). Network interface 36' is substantially the same as network interface 36 except that it is connected to receive barrier status information from status receiver 302.

The status monitor 800 is known in the art. For example, a status monitor which could be used in accordance with the present invention is described in U.S. Pat. No. 5,402,105 to Doyle et al.

Generally, the status monitor 800 includes a tilt switch and an RF transmitter coupled to the tilt switch. When the movable barrier 12, opens, the tilt switch will change states. The RF transmitter will then send the status signal to the network interface 36'. The status of the movable barrier can then be accessed over the network 102, such as described with reference to FIG. 1. It should be mentioned that the RF communication between status monitor 800 and status receiver 302 could be done via a wireless network such as, for example, a Bluetooth network or 802.11.

While the invention herein disclosed has been described by means of specific embodiments and applications thereof, other modifications, variations, and arrangements of the present invention may be made in accordance with the above teachings other than as specifically described to practice the invention within the spirit and scope defined by the following claims.

What is claimed is:

1. An apparatus comprising:

a movable barrier operator including a controller for controlling movement of a movable barrier; and a network interface electronically connected to the controller for connecting the controller to a network;

wherein the network interface responds to requests received on the network by sending a status of the movable barrier over the network and;

wherein the network interface receives a status change request from the network and the controller responds to the status change request by moving the barrier.

2. The apparatus of claim 1 further comprising a push button control unit for the movable barrier operator.

3. The apparatus of claim 2 further comprising a serial interface between the push button control unit and the network interface.

4. The apparatus of claim 1 further comprising a modem coupled to the network interface.

5. The apparatus of claim 4 wherein the modem is a cable modem.

6. The apparatus of claim 4 wherein the modem is a DSL modem.

7. The apparatus of claim 1 wherein the network interface is connected to a home digital network.

8. The apparatus of claim 1 wherein the network interface is connected to a home digital network.

9. The apparatus of claim 1 wherein the network interface is a TCP/IP network interface.

10. The apparatus of claim 1 wherein the network interface couples the controller to the Internet.

11. The apparatus of claim 1 comprising an arrangement for establishing authorization for received status change requests.

12. A method for checking the status of a movable barrier comprising the steps of:

receiving from a network client over a network, a status request for a movable barrier;

determining a status of the movable barrier;

sending a status of the movable barrier over the network to the network client in response to the status request and;

wherein the movable barrier comprises a barrier movement operator for controlling the movement of the barrier and the method comprises receiving a status change request from the network client and controlling movement of the barrier in response to the status change request.

13. A method of claim 12 further comprising the step of receiving access authorizing information from the network client.

14. A method of claim 12 further comprising the step of retrieving from a memory a web page in response to the receiving step.

15. A method of claim 12 wherein the status of the movable barrier is open.

16. A method of claim 12 wherein the status of the movable barrier is closed.

17. The method of claim 12 wherein the network client is a computer.

18. The apparatus of claim 17 wherein the status of the movable barrier is displayed on a monitor of the computer.

19. The method of claim 12 wherein the network client is a personal digital assistant.

20. The method of claim 12 wherein the network client is a cellular telephone.

21. A method in accordance with claim 12 comprising receiving authorizing information from the network client before controlling movement of the barrier in response to the status change request.

22. An apparatus comprising:

a barrier status monitor coupled to a movable barrier; and a network interface electronically connecting the barrier status monitor to a network;

a controller coupled to the network interface and the moveable barrier;

wherein the network interface responds to network conveyed requests by sending a status of the movable barrier over the network in response to a request for the status of the movable barrier; and wherein the network interface receives a status change request from the network and the controller responds to the status change request by moving the barrier.

23. The apparatus of claim 22 wherein the status monitor is wirelessly connected to the network interface.

24. The apparatus of claim 22 further comprising a modem coupled to the network interface.

25. The apparatus of claim 24 comprising an arrangement for establishing authorization for requested status.

* * * * *